US008348394B2

(12) United States Patent
Miyata

(10) Patent No.: US 8,348,394 B2
(45) Date of Patent: Jan. 8, 2013

(54) LIQUID EJECTING HEAD

(75) Inventor: Yoshinao Miyata, Matsukawa-mura (JP)

(73) Assignee: Seiko Epson Corporation, Tokyo (JP)

( * ) Notice: Subject to any disclaimer, the term of this patent is extended or adjusted under 35 U.S.C. 154(b) by 154 days.

(21) Appl. No.: 13/029,974

(22) Filed: Feb. 17, 2011

(65) Prior Publication Data

US 2011/0199437 A1 Aug. 18, 2011

(30) Foreign Application Priority Data

Feb. 18, 2010 (JP) ..... 2010-033217

(51) Int. Cl.
*B41J 2/045* (2006.01)
*B41J 2/14* (2006.01)
*B41J 2/16* (2006.01)

(52) U.S. Cl. ..... 347/68; 347/50

(58) Field of Classification Search ..... None
See application file for complete search history.

(56) References Cited

U.S. PATENT DOCUMENTS

2005/0179730 A1* 8/2005 Majima et al. ..... 347/50
2005/0219325 A1* 10/2005 Sugahara ..... 347/58

FOREIGN PATENT DOCUMENTS

JP 2005-131881 5/2005

* cited by examiner

*Primary Examiner* — Matthew Luu
*Assistant Examiner* — Lisa M Solomon
(74) *Attorney, Agent, or Firm* — Workman Nydegger

(57) ABSTRACT

A discrete element electrode terminal and a driving IC are formed between piezoelectric element rows. A circuit substrate is placed at a side opposite to a flow path substrate side of the driving IC. An input pad is formed on an elastic film at a position corresponding to an inter terminal of the driving IC. An output terminal of the driving IC is electrically bonded to the discrete element electrode terminal, the input terminal of the driving IC is electrically bonded to the input pad, and the input pad is electrically bonded to a substrate terminal of the circuit substrate.

10 Claims, 7 Drawing Sheets

LIQUID EJECTING HEAD

The entire disclosure of Japanese Patent Application No: 2010-033217, filed Feb. 18, 2010 are expressly incorporated by reference herein.

BACKGROUND

1. Technical Field

The present invention relates to a liquid ejecting head such as an ink jet type recording head, and more particularly, to a liquid ejecting head including a wiring terminal row which is formed by arranging in row wiring terminals corresponding to pressure generating elements of the liquid ejecting head.

2. Related Art

As a kind of a liquid ejecting head which discharges the liquid as liquid droplets from nozzles by changing pressure in a liquid in a pressure chamber, there is the liquid ejecting head with a configuration in which a piezoelectric element (a kind of a pressure generating element) bonded to a vibration plate is deformed to eject the liquid droplets. A driving voltage (driving pulse) is applied to the liquid ejecting head, so that the piezoelectric element is driven to change the volume of the pressure chamber and pressure is changed in the liquid stored in the pressure chamber. The liquid droplets are ejected from the nozzles by using the pressure change.

Recording heads of the related art are provided with a circuit substrate (a printed substrate) receiving a driving signal or a control signal from the printer body side. The circuit substrate is electrically connected to the piezoelectric element by a film-shaped wiring member (hereinafter referred to as a flexible cable) or a TCP (Tape Carrier Package) such as COF (Chip On Film) which is mounted with a driving IC to control driving of the piezoelectric element. The driving voltage is supplied to the piezoelectric element via the flexible cable (e.g., JP-A-2005-131881).

However, as described above, in the configuration in which the flexible cable is wired between the circuit substrate and the actuator, since a space for placing the flexible cable is required, it is difficult to reduce the size of the recording head by as much as the space required for the flexible cable.

SUMMARY

An advantage of some aspects of the invention is that it reduces the size of a liquid ejecting head.

According to an aspect of the invention, there is provided a liquid ejecting head including; an actuator unit having a pressure generating element which changes pressure in a liquid in a pressure chamber by applying a driving voltage between a discrete element electrode and a common element electrode to eject the liquid from nozzles which are linked with the pressure chamber, the actuator unit having plural pressure generating element groups in which a plurality of pressure generating elements are provided in row; a discrete element electrode terminal which is electrically conducted with a discrete element terminal of the pressure generating element and is formed between the pressure generating element groups on a pressure generating element mounting surface of a substrate with the pressure chamber formed thereon; a driving IC which is placed between the adjacent pressure generating element groups on the pressure generating element mounting surface; a printed substrate which is placed at a side opposite to the substrate side of the driving IC; and an input pad which is formed at a position corresponding to an input terminal of the driving IC on the pressure generating element mounting surface; in which an output terminal of the driving IC is electrically bonded to the discrete element electrode terminal, the input terminal of the driving IC is electrically bonded to the input pad, and the input pad is electrically bonded to a substrate terminal of the printed substrate.

According to the invention, since the discrete element electrode terminal is formed between the pressure generating element groups on the pressure generating element mounting surface of the substrate, the driving IC is placed between the adjacent pressure generating element groups on the pressure generating element mounting surface, the printed substrate is placed at the side opposite to the substrate side of the driving IC, and the input pad is formed at the position corresponding to the input terminal of the driving IC on the pressure generating element mounting surface, in which the output terminal of the driving IC is electrically bonded to the discrete element electrode terminal, the input terminal of the driving IC is electrically bonded to the input pad, and the input pad is electrically bonded to the substrate terminal of the printed substrate. Therefore, a wiring member such as COF which is used in the wiring between a printed substrate and an actuator unit in the configuration of the related art is not necessary, so that the installation area can be reduced by as much as the space for the wiring member. Consequently, it is possible to reduce the size of the liquid ejecting head. In addition, since the wiring member is not used, the cost can be decreased by as much as the cost of the wiring member.

In the configuration, it is preferable to employ a configuration in which the output terminal of the driving IC is bonded to the discrete element electrode terminal by using flip chip bonding.

According to the configuration, since the output terminal of the driving IC is directly connected to the discrete element electrode terminal without using a bonding wire, a wiring space is reduced, and thus it contributes to a size reduction in the liquid ejecting head.

In addition, in the configuration, it is preferable to employ a configuration in which the input pad is bonded to the substrate terminal of the printed substrate by a bonding wire.

According to the configuration, even in a configuration in which the terminal forming surface of the driving IC faces a side opposite to the printed substrate, the input terminal of the driving IC can be electrically bonded to the substrate terminal of the printed substrate.

Further, in the configuration, it is preferable to employ a configuration in which a common element electrode wiring portion electrically conducted with the common element electrode, and a common electrode pad electrically conducted with the common element electrode wiring portion are formed at a position deviated from a region in which the pressure generating element groups and the discrete element electrode terminal are formed, on the pressure generating element mounting surface, and in which a ground terminal of the driving IC is electrically bonded to the common electrode pad.

In addition, it is preferable that the printed substrate employs a configuration in which a connector connected to an external wiring is provided on a surface opposite to the driving IC in a state where a wiring connection hole faces a side opposite to the driving IC.

Further, there may be provided a liquid ejecting apparatus including the liquid ejecting head having the above-described configuration. According to the invention, it is possible to reduce the size of the liquid ejecting apparatus. In addition, since the wiring member is not used, the cost can be reduced by as much as the cost of the wiring member.

BRIEF DESCRIPTION OF THE DRAWINGS

The invention will be described with reference to the accompanying drawings, wherein like numbers reference like elements.

DESCRIPTION OF EXEMPLARY EMBODIMENTS

One embodiment of the invention will now be described with reference to the accompanying drawings. In this instance, the embodiment described below is variously limited as a preferable example of the invention, but the scope of the invention is not limited to an aspect other than that specifically described to limit the invention. In addition, a liquid ejecting head of the invention will be described by giving an example of an ink jet type recording head (hereinafter referred to as a recording head) mounted in an ink jet type printer (a kind of liquid ejecting apparatus according to the invention) as an example.

Figure 1:
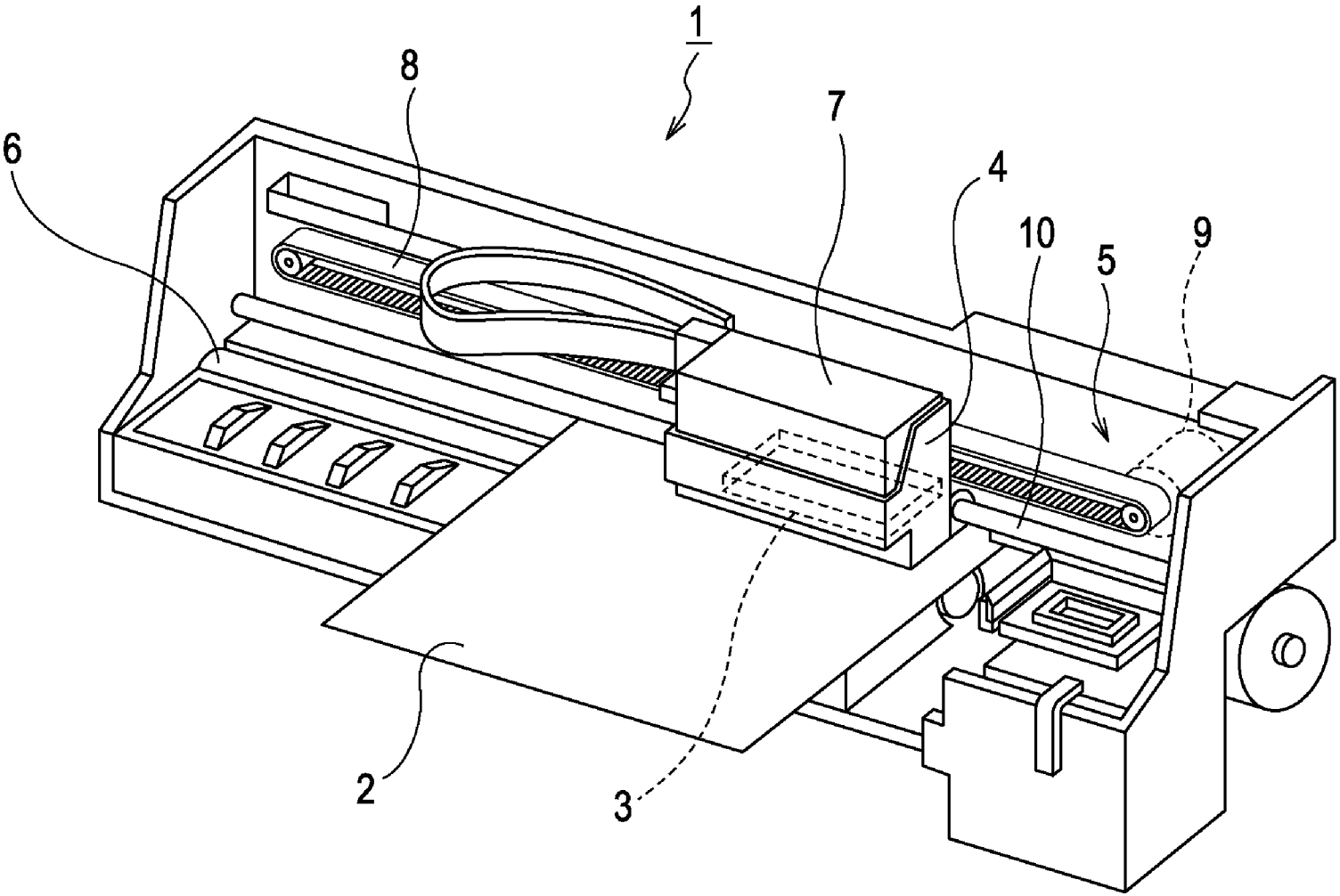
FIG. 1 is a perspective view illustrating the configuration of a printer.

First, the simple configuration of the printer will now be described with reference to FIG. 1. The printer 1 is an apparatus capable of recording an image or the like by ejecting ink in liquid form onto a surface of a recording medium 2 such as recording paper or the like. The printer 1 includes a recording head 3 ejecting the ink, a carriage 4 to which the recording head 3 is attached, a carriage moving mechanism 5 moving the carriage 4 in a main scanning direction, and a platen roller 6 carrying the recording medium 2 in a sub scanning direction or the like. The ink is a kind of liquid of the invention, and is stored in an ink cartridge 7. The ink cartridge 7 is detachably mounted in regard to the recording head 3. Here, a configuration may be adopted where the ink cartridge 7 is placed at a body side of the printer 1 so that the ink is supplied to the recording head 3 from the ink cartridge 7 through an ink supply tube.

The carriage moving mechanism 5 includes a timing belt 8. The timing belt 8 is driven by a pulse motor 9 such as a DC motor. Accordingly, if the pulse motor 9 is operated, the carriage 4 is guided to a guide road 10 which is disposed in the printer 1, and thus reciprocates in a main scanning direction (the widthwise direction of the recording medium 2).

Figure 2:
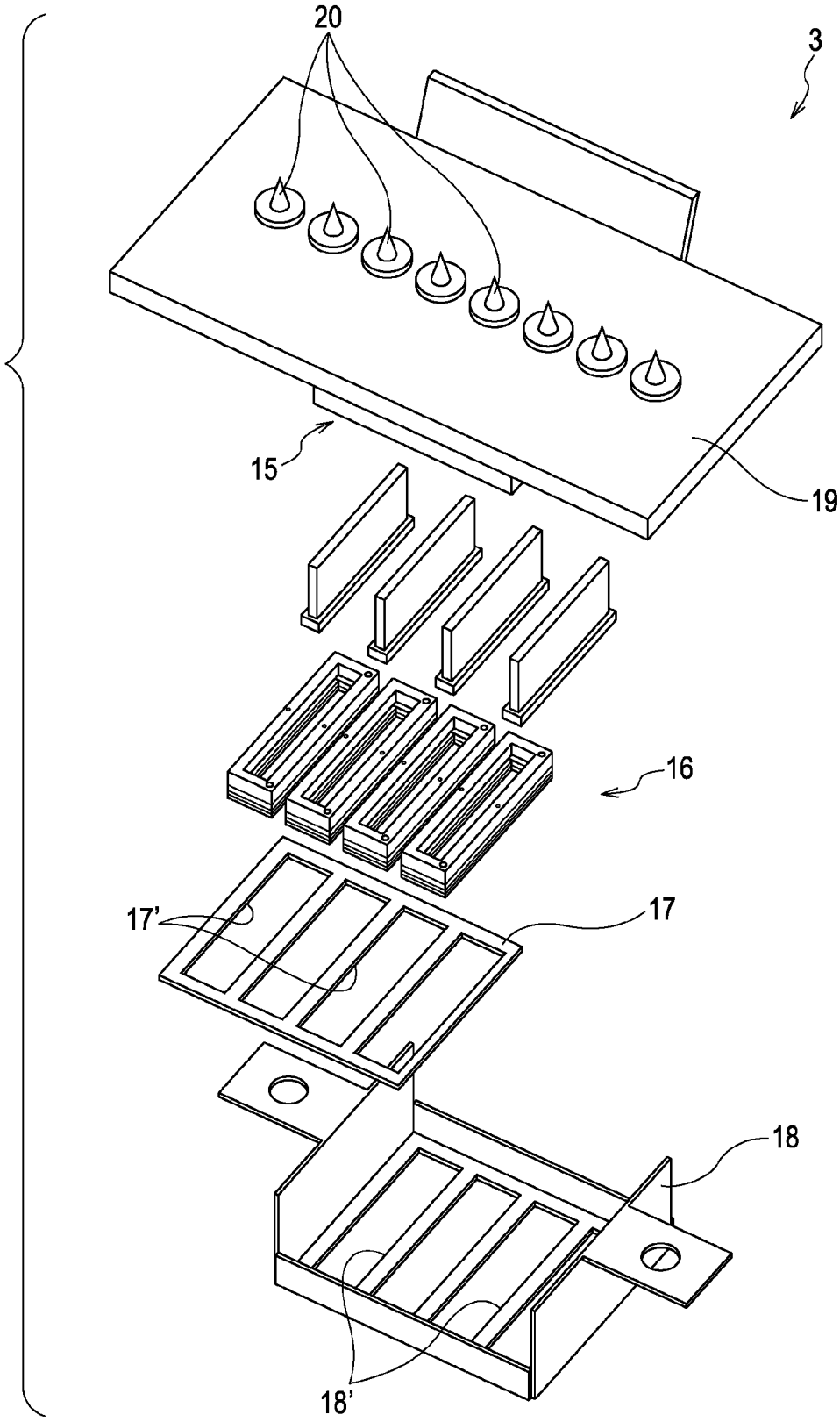
FIG. 2 is an exploded perspective view illustrating a recording head at an oblique angle seen from above.

FIG. 2 is an exploded perspective view illustrating the configuration of the recording head 3. In this embodiment, the recording head 3 is substantially constituted of a case 15, a plurality of head units 16, a unit fixing plate 17 and a head cover 18.

The case 15 is a box-shaped member accommodating the head unit 16 and a focusing flow path (not illustrated) therein, and is provided with a needle holder 19 at an upper surface side. The needle holder 19 is a plate-shaped member to attach an ink introducing needle 20. In this embodiment, eight ink introducing needles 20 corresponding to ink colors of the ink cartridge 7 are arranged in row in a horizontal direction in the needle holder 19. The ink introducing needle 20 is a hollow needle-shape member which is inserted into the ink cartridge 7, and introduces the ink which is stored in the ink cartridge 7 to the head unit 16 side from an inlet hole (not illustrated) provided in a front end through the focusing flow path in the case 15.

In addition, four head units 16 are bonded to the unit fixing plate 17 made of metal at the bottom surface side of the case 15 in a state where the four head units 16 are positioned in row in a horizontal direction along the main scanning direction. The unit fixing plate 17 has four opening portions 17' corresponding to the respective head units 16. Similarly, the four head units 16 are fixed by the head cover 18 made of metal in which four opening portions 18' corresponding to the respective head units 16 are opened.

Figure 3:
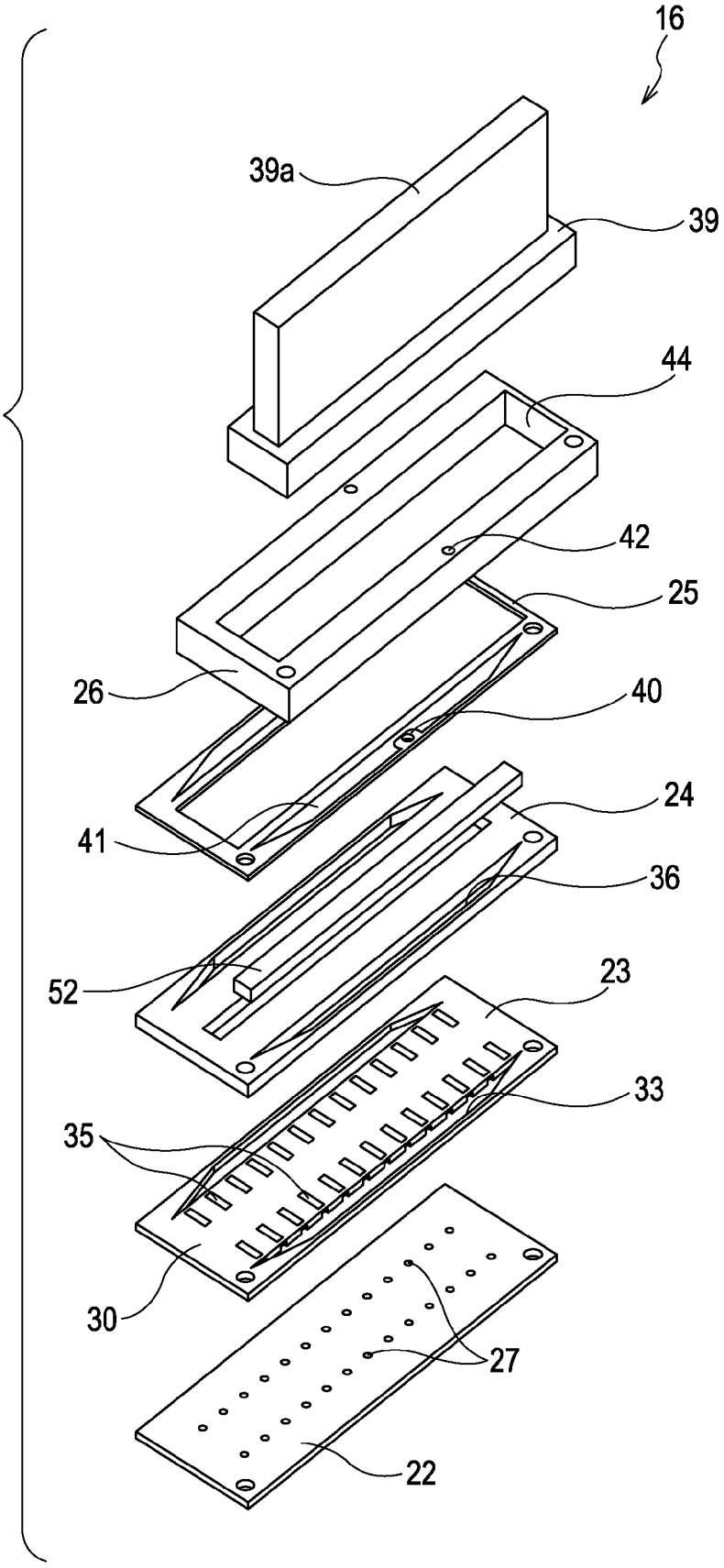
FIG. 3 is an exploded perspective view of a head unit.
Figure 4:
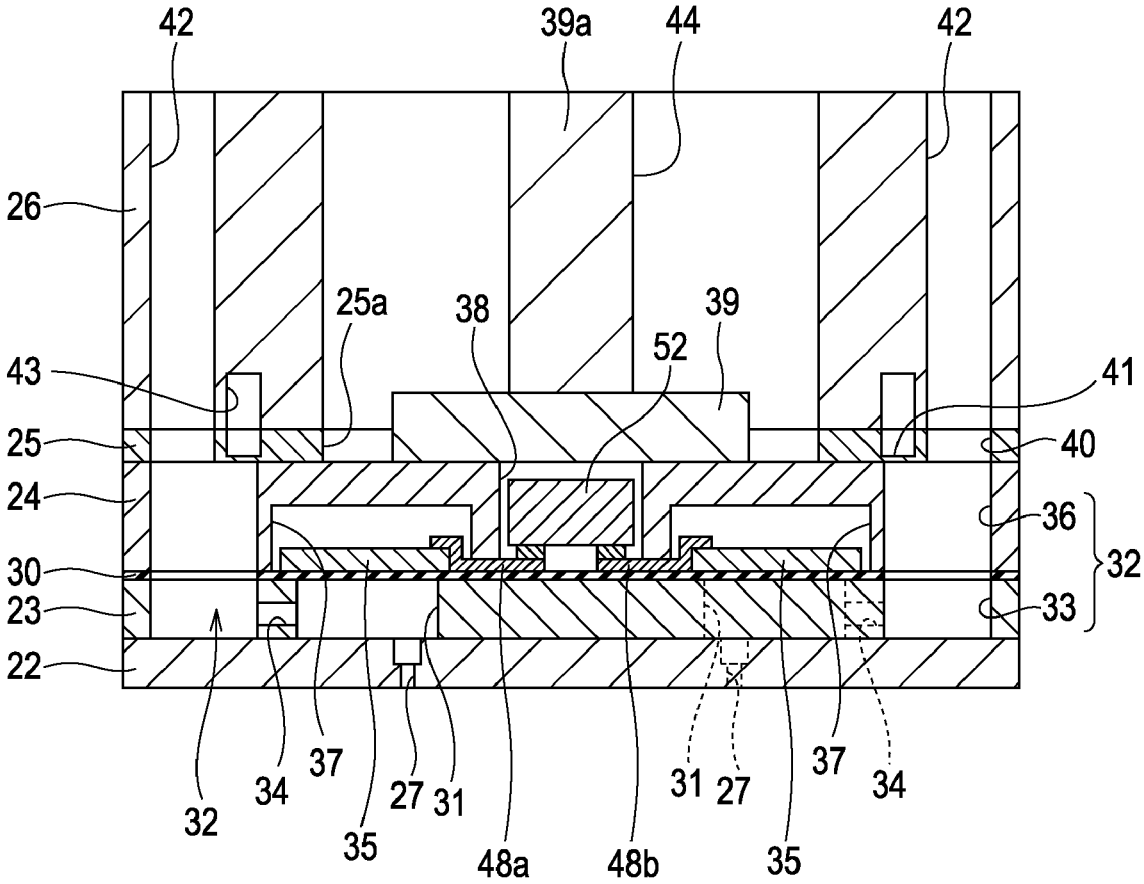
FIG. 4 is a cross-sectional view of a head unit.
Figure 5:
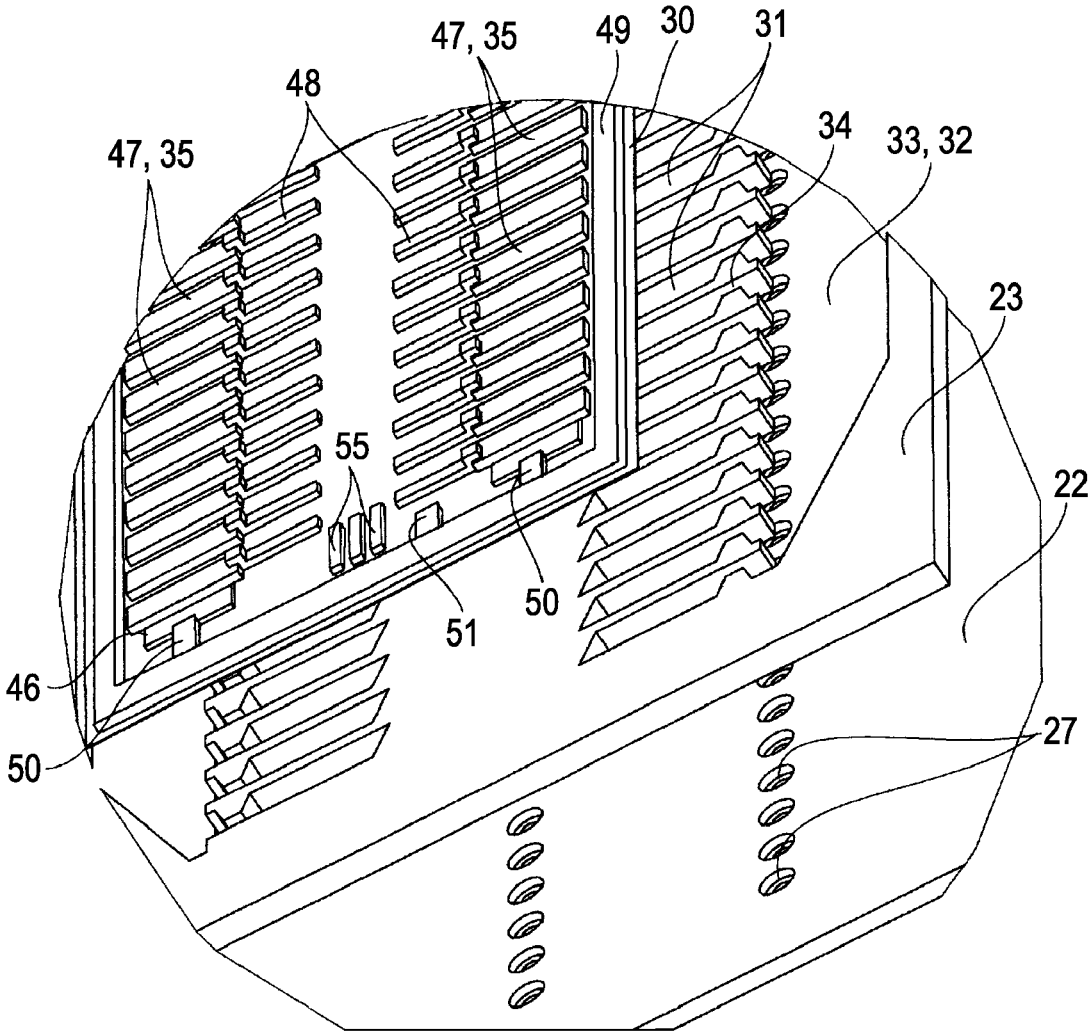
FIG. 5 is a partially exploded perspective view illustrating a head unit with a part of the configuration being omitted.

FIG. 3 is an exploded perspective view illustrating the configuration of the head unit 16 (the liquid ejecting head defined more narrowly than the recording head 3), and FIG. 4 is a cross-sectional view of the head unit 16. In addition, FIG. 5 is a partially exploded perspective view illustrating the head unit 16, with a part of the configuration being omitted. In the description, a stacked direction of the respective members is referred to as an upper and lower direction, for convenience.

The head unit 16 according to this embodiment is substantially constituted of a nozzle plate 22, a flow passage substrate 23, a protective substrate 24, and a compliance substrate 25, and is bonded to the unit case 26, with these members being stacked.

The nozzle plate 22 (a kind of the nozzle forming member) is a plate-shaped member, in which a plurality of nozzles 27 are provided in row at a pitch corresponding to the dot formation density. In this embodiment, a nozzle array (a kind of the nozzle group) is formed by providing 300 nozzles 27 in row at a pitch corresponding to 300 dpi. In this embodiment, the nozzle plate 22 is provided with two nozzle arrays.

The flow passage substrate 23 (corresponding to a substrate formed with the pressure chamber according to the invention) has an elastic film 30 made of silicon dioxide formed by thermal oxidation on an upper surface thereof. In addition, the flow passage substrate 23 is provided with a plurality of pressure chambers 31 in correspondence to the respective nozzles 27, and each of the pressure chambers 31 is subjected to an anisotropic etching process so as to be positioned by a plurality of partitions, as shown in FIGS. 4 and 5. A linking space portion 33 is formed at the outside of the row of the pressure chambers 31 in the flow passage substrate 23, and the linking space portion 33 partitions a portion of a common liquid chamber 32 as a chamber to which common ink of the respective pressure chambers 31 is introduced. The linking space portion 33 is linked with each of the pressure chambers 31 via an ink supply passage 34.

On the elastic film 30 (corresponding to the pressure generating element mounting surface according to the invention) formed on the upper surface of the flow passage substrate 23, a plurality of piezoelectric elements 35 (a kind of the pressure generating element according of the invention), which are respectively formed by sequentially stacking a lower metallic electrode film (common element electrode 46), a piezoelectric layer (not illustrated) made of lead zirconate titanate (PZT) or the like, and an upper electrode film (a discrete element electrode 47) made of metal, are arranged in row for every pressure chamber 31. In this embodiment, two rows of piezoelectric elements (corresponding to the pressure generating element group according to the invention) corresponding to a nozzle array of two rows are arranged in parallel in a direction perpendicular to the nozzle array in the state where the piezoelectric elements 35 are staggered when viewed from a nozzle array direction. The piezoelectric element 35 is a so-called piezoelectric element of a flexure mode, and is formed to cover the upper portion of the pressure chamber 31. In this instance, a configuration may be employed where the lower electrode film is the discrete element electrode 47 and the upper electrode film is the common element electrode 46.

Each of electrode wiring portions 48 and 49 extends over the elastic film 30 from the respective element electrodes 47 and 46 of the piezoelectric element 35, and a terminal of a driving IC 52 driving the piezoelectric element 35 is electrically connected to a portion corresponding to the electrode terminal (an electrode pad) of the electrode wiring portion. Each of the piezoelectric elements 35 is configured such that the piezoelectric element is deformed due to application of a driving voltage between the discrete element electrode 47 and the common element electrode 46 via the driving IC 52. In this embodiment, the unit including the elastic film 30, the piezoelectric element 35 having the respective electrodes 46 and 47, the electrode wiring portions 48 and 49 conducted with each electrode of the piezoelectric element 35, the terminal formed on the elastic film 30 and the like corresponds to an actuator unit according to the invention.

The protective substrate 24 having a through-space portion 36 penetrating the substrate in a thickness direction is placed on the flow passage substrate 23 with the piezoelectric element 35 formed thereon. The through-space portion 36 of the protective substrate 24 is linked with the linking space portion 33 of the flow passage substrate 23 to partition a portion of the common liquid chamber 32. In addition, the protective substrate 24 is provided at a region opposite to the piezoelectric element 35 with a piezoelectric element receiving space portion 37 of such a size so as not to impede the driving of the corresponding piezoelectric element 35. Furthermore, the protective substrate 24 is provided with a wiring space portion 38 penetrating the protective substrate in the thickness direction between the adjacent piezoelectric element rows (corresponding to the pressure generating element groups according to the invention). The discrete element electrode terminal 48 of the piezoelectric element 35 or the common element electrode terminal 51 and the driving IC 52 are placed in the wiring space portion 38, when seen from the plane. That is, the circuit substrate 39 is placed on the protective substrate 24 over the wiring space portion 38. That is, the circuit substrate 39 is placed at a side opposite to the substrate side with respect to the driving IC 52. The circuit substrate 39 is a printed substrate provided with a circuit wiring which supplies a driving signal or a control signal input from a control unit of a printer body side to the driving IC 52 via the external wiring (not illustrated). In addition, the circuit substrate 39 is provided with substrate terminals (not illustrated) corresponding to input/output terminals of the driving IC 52 and a connector 39*a* connected to the external wiring. The connector 39*a* is installed on the circuit substrate 39 in a state where a wiring connection port faces a side opposite to the driving IC 52 side.

The compliance substrate 25 is placed on the upper surface side of the protective substrate 24. The region of the compliance substrate 25 which is opposite to the through-space portion 36 of the protective substrate 24 is provided with an ink inlet port 40 which penetrates the region in the thickness direction to supply the ink from the ink inlet needle 20 side to the common liquid chamber 32. In addition, the region of the compliance substrate 25 except for the ink inlet port 40 opposite to the through-space portion 36 and a through-hole 25*a* described below is formed with a flexible portion 41 formed to be extremely thin. The upper opening of the through-space portion 36 is sealed by the flexible portion 41 so that the common liquid chamber 32 is partitioned. The flexible portion 41 serves as a compliance portion capable of absorbing pressure changes of the ink in the common liquid chamber 32. In addition, the through-hole 25*a* is formed in the central portion of the compliance substrate 25. The through-hole 25*a* is linked with the space portion 44 of the unit case 26.

The unit case 26 is a member which is provided with an ink inlet passage 42 which is linked with the ink inlet port 40 to supply the ink introduced from the ink inlet needle 20 side to the common liquid chamber 32 side, and a concave portion 43 which is formed at a region opposite to the flexible portion 41 and allows the flexible portion 41 to expand. A space 44 is formed in the central portion of the unit case 26 such that the space penetrates the unit case in a thickness direction. The space portion 44 is linked with the through-hole 25*a* of the compliance substrate 25. The circuit substrate 39 and its connector 39*a* are accommodated in the space formed thereby.

The nozzle plate 22, the flow path substrate 23, the protective substrate 24, the compliance substrate 25 and the unit case 26 are stacked, with an adhesive, a thermal welding film or the like being interposed between them, and then are bonded to each other by heating.

The recording head 3 including the head unit 16 configured as described above is attached to the carriage 4 such that the direction of the nozzle array coincides with the sub scanning direction in a state where the respective nozzle plates 22 are opposite to the platen. In the respective head units 16, the ink of the ink cartridge 7 is received from the ink inlet port 40 through the ink inlet passage 42 at the common liquid chamber 32 side, so that the ink flow path (a kind of the liquid flow path) extending from the common liquid chamber 32 to the nozzle 27 is filled with the ink. The piezoelectric element 35 is bent and deformed by supplying the driving voltage to the piezoelectric element 35, and thus pressure changes are produced in the ink filled in the corresponding pressure chamber 31. Consequently, the ink is ejected from the nozzle 27 by the pressure changes of the ink.

Figure 6:
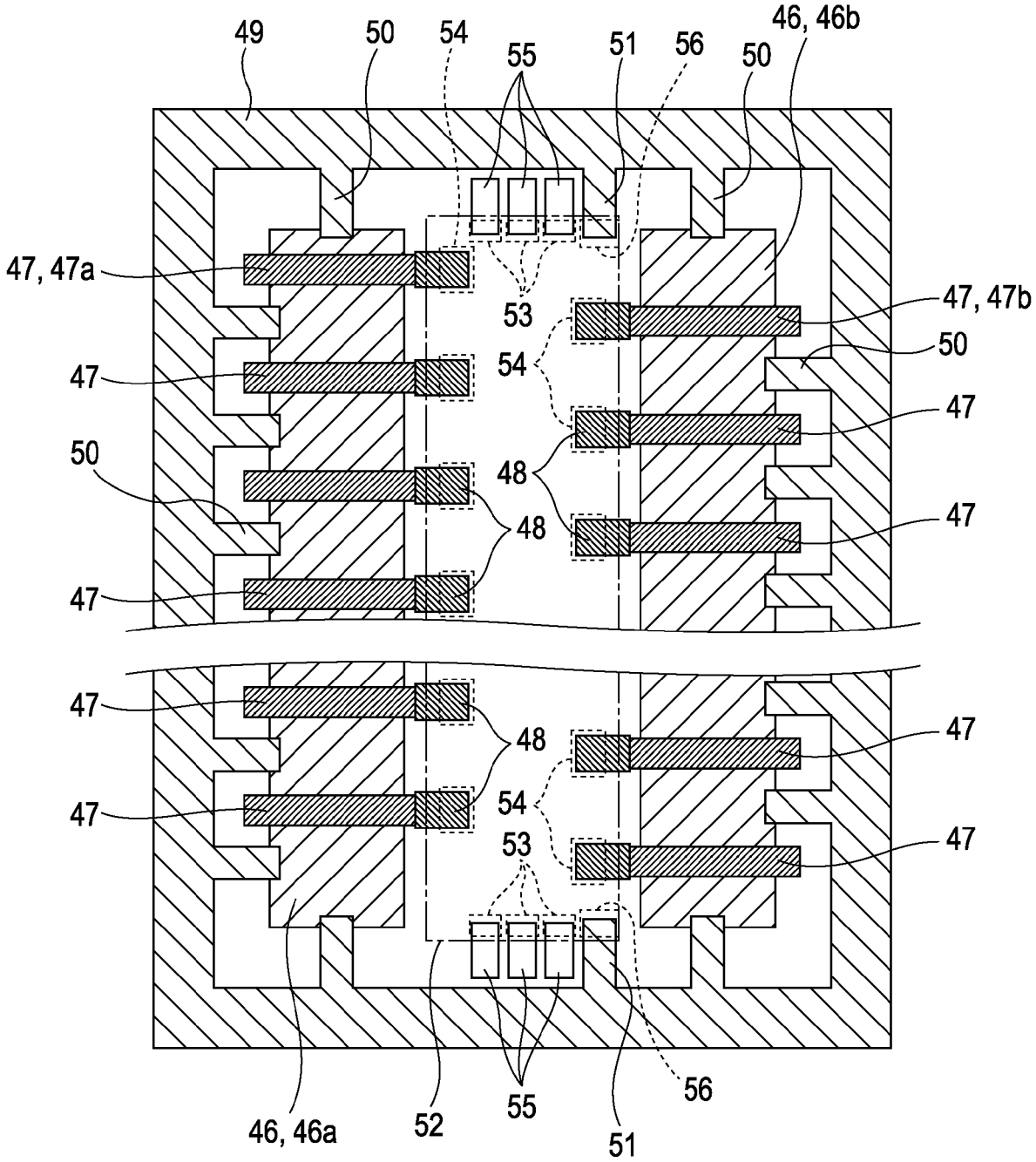
FIG. 6 is a schematic view illustrating a layout of an element electrode of a piezoelectric element and an element electrode wiring portion.
Figure 7A:
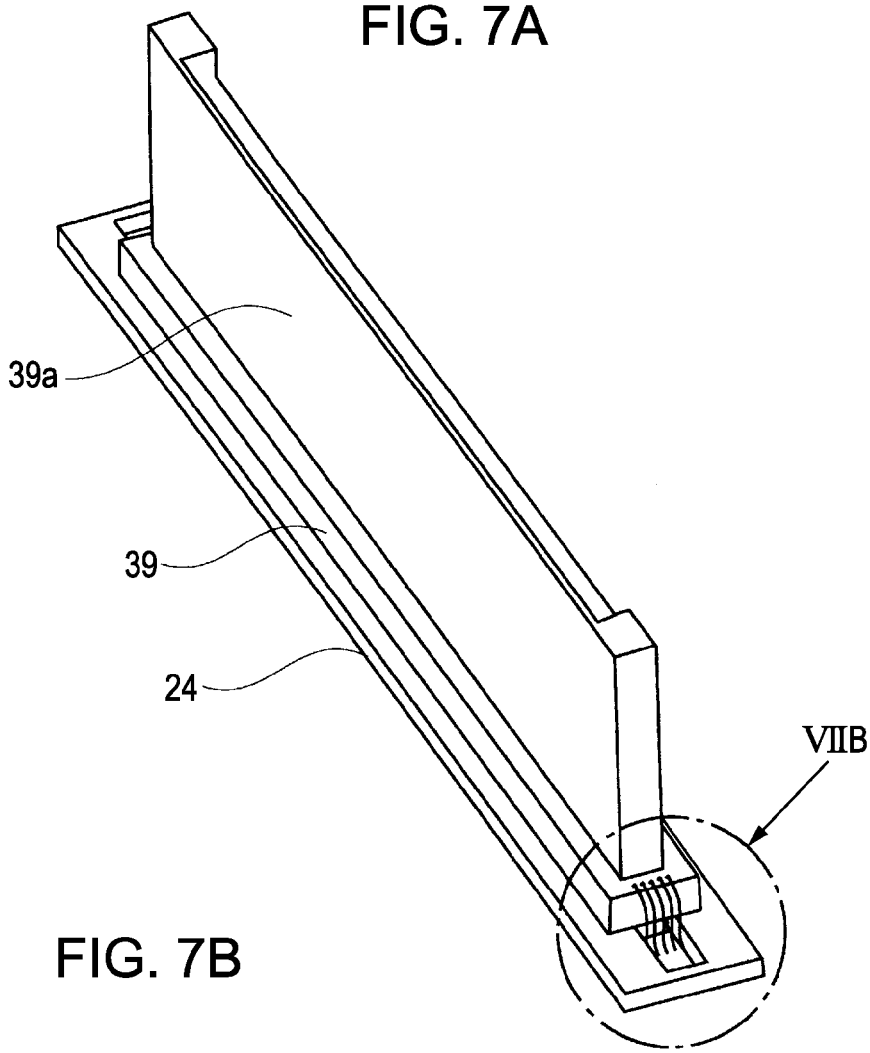
FIGS. 7A and 7B are diagrams illustrating the wiring of a circuit substrate and a driving IC for an actuator unit.
Figure 7B:
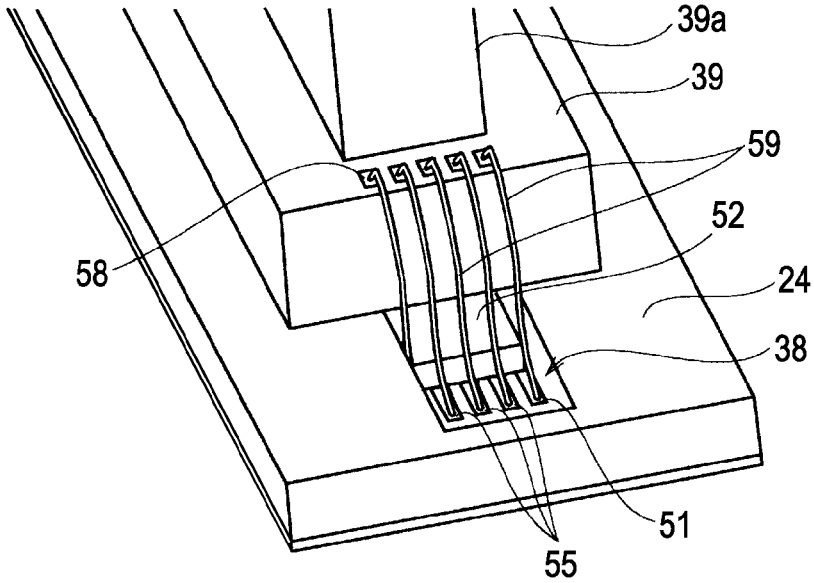

FIG. 6 is a schematic view illustrating the layout of the element electrode of the piezoelectric element 35 and the element electrode wiring portion extending from the corresponding element electrode. In addition, FIGS. 7A and 7B are diagrams illustrating the wiring of the circuit substrate 39 and the driving IC 52 for the actuator unit, in which FIG. 7A is a perspective view of the protective substrate 24, the driving IC 52, the circuit substrate 39 and the connector 39*a*, and FIG. 7B is an enlarged view of the region VIIB in FIG. 7A. In this instance, in FIG. 6, the portion shown by dense shading indicates the discrete element electrode 47 and the discrete element electrode wiring portion 48 electrically conducted with the discrete element electrode, and the portion shown by light shading indicates the common element electrode 46 and the common element electrode wiring portion 49 electrically conducted with the common element electrode. In addition, in the same figure, a longitudinal direction is a nozzle array installation direction (a direction of piezoelectric element row), and the configuration corresponding to two rows of the nozzle arrays is shown. In this embodiment, platinum or gold is used as a material for the electrode film.

In this embodiment, the common element electrodes 46 (46*a* and 46*b*) common to the respective piezoelectric elements 35 on the elastic film 30 which partitions a part of the pressure chamber 31 are continuously formed in a rectangular shape when seen from the plane which is long in the same direction along the direction of the nozzle array. A piezoelectric body layer (not illustrated) and the discrete element electrode 47 (47*a* and 47*b*) are sequentially stacked thereon and patterned for very piezoelectric element 35. The size of the discrete element electrode 47 in the longitudinal direction is slightly longer than the width of the common element electrode 46 in a direction of the shorter length. In addition, the discrete element electrodes 47 are arranged in a line in such a way that the size of the discrete element electrode 47 in the widthwise direction (a direction of shorter length) is substantially equal to the width of the pressure generating element 35. The discrete element electrode terminal 48 (a kind of the discrete element electrode wiring portion) electrically conducted with the discrete element electrode 47 is formed at a position corresponding to the output terminal 53 of the driving IC 52 between the adjacent piezoelectric element rows. The discrete element electrode terminal 48 corresponding to one nozzle array (the left side in the figure) and the discrete element electrode terminal 48 corresponding to the other nozzle array (the right side in the figure) are arranged in row at a certain pitch in such a way that the discrete element electrode terminals are staggered in the direction of the nozzle array.

In addition, the common element electrode portion 49 (a kind of the common element electrode wiring portion) of a frame shape is formed on the elastic film 30 to enclose the region in which the common element electrode 46, the discrete element electrode 47, and the discrete element electrode terminal 48 are formed. The common element electrode portion 49 is electrically conducted with the respective common element electrodes 46*a* and 46*b* via a branched electrode portion 50. Furthermore, the common element electrode terminal 51 (a kind of the common electrode pad) electrically conducted with the common element electrode portion 49 is formed at a position which is in the frame of the common electrode portion 49 on the elastic film 30 and is deviated from the region formed with the common element electrode 46, the discrete element electrode 47, and the discrete element electrode terminal 48. The common element electrode terminal 51 is extended to the position corresponding to the ground terminal 56 of the driving IC 52.

On the terminal forming surface of the driving IC 52, the respective output terminals 54 are formed at a position corresponding to each of the discrete element electrode terminals 48 of the actuator unit, and the respective ground terminals 56 are formed at the position corresponding to the common element electrode terminals 51 of the actuator unit. In addition, on the terminal forming surface of the driving IC 52, the input terminal 53 is formed at the position corresponding to the input pad 55 for the actuator unit. The driving IC 52 is placed between the piezoelectric element rows, with the terminal forming surface side facing the actuator unit side, in the state in which the planar position of the input/output terminal is aligned with the planar position of the respective terminals (the pads) corresponding to the actuator unit side. In this state, the output terminal 54 is electrically bonded to the discrete element electrode terminal 48 corresponding to the output terminal, and the input terminal 53 is electrically bonded to the input pad 55. That is, each of the terminals of the driving IC 52 is bonded to the terminal corresponding to the actuator unit side by flip chip bonding. As the bonding method using the flip chip bonding, an existing method such as ultrasonic bonding or bonding using conductive adhesive can be employed. Therefore, in this embodiment, since each of the terminals of the driving IC 52 is directly bonded to the terminal corresponding to the actuator unit side without using the bonding wire, the wiring space is reduced, and thus it leads to miniaturization of the recording head 3.

After the driving IC 52 is mounted on the actuator unit, the protective substrate 24 is attached to the actuator unit in a state where the driving IC 52 is accommodated in the wiring space portion 38, and then the circuit substrate 39 is placed on the protective substrate 24. As shown in FIG. 7B, the input pad 55 and the common element electrode terminal 51 are electrically connected to the corresponding substrate terminal 58 via the bonding wire 59 on each of the circuit substrates 39 at positions different from the bonding portion of the terminal of the driving IC 52. According to the configuration, as shown in this embodiment, even in the configuration in which the terminal forming surface of the driving IC 52 faces the side opposite to the circuit substrate 39, it is possible to electrically bond the terminal of the driving IC 52 to the substrate terminal of the printed substrate. After the wiring between the driving IC 52 and the circuit substrate 39 is performed, the external wiring is connected to the connector 39*a* of the circuit substrate 39. Consequently, the driving signal or the like sent from the control unit of the printer 1 via the external wiring is received by the driving IC 52 via the circuit substrate 39, and the corresponding driving IC 52 can control each of the piezoelectric elements 35 based on the driving signal or the like.

As described above, the recording head 3 according to the invention does not need the wiring member, such as COF, used in the wiring of the circuit substrate and the actuator unit in the recording head according to the related art. As a result, the installation area can be reduced by as much as space for the wiring member, and thus the size of the recording head 3 can be decreased. In addition, since the wiring member is not used, the cost can be reduced by as the cost of as much as the wiring member. Furthermore, since the wiring member is not used, the wiring work is easily performed.

In the above-described embodiment, although the ink jet type recording head 3 (the head unit 16) which is a kind of liquid ejecting head is exemplified, the invention may be applied to other liquid ejecting heads having a configuration capable of supplying driving voltages to the pressure generating element via the flexible cable. For example, the invention may be applied to a color material ejecting head which is used during manufacturing a color filter such as a liquid crystal display, an electrode material ejecting head used at formation of an electrode such as an organic EL (Electro Luminescence) display, or an FED (Field Emission Display), a bioorganic compound ejecting head which is used to manufacture bio chips (a biochemical device) or the like.

What is claimed is:

1. A liquid ejecting head comprising:

an actuator unit having a pressure generating element which creates pressure change in a liquid in a pressure chamber by applying a driving voltage between a discrete element electrode and a common element electrode to eject the liquid from nozzles which communicate with the pressure chamber, the actuator unit having plural pressure generating element groups in which a plurality of pressure generating elements are provided in row;

a discrete element electrode terminal which is electrically conducted with a discrete element terminal of the pressure generating element and is formed between the pressure generating element groups on a pressure generating element mounting surface of a substrate with the pressure chamber formed thereon;

a driving IC which is placed between the adjacent pressure generating element groups on the pressure generating element mounting surface;

a printed substrate which is placed at a side opposite to the substrate side of the driving IC; and an input pad which is formed at a position corresponding to an input terminal of the driving IC on the pressure generating element mounting surface;

in which an output terminal of the driving IC is electrically bonded to the discrete element electrode terminal, the input terminal of the driving IC is electrically bonded to the input pad, and the input pad is electrically bonded to a substrate terminal of the printed substrate.

2. The liquid ejecting head according to claim 1, wherein the output terminal of the driving IC is bonded to the discrete element electrode terminal by using flip chip bonding.

3. The liquid ejecting head according to claim 1, wherein the input pad is bonded to the substrate terminal of the printed substrate with a bonding wire.

4. The liquid ejecting head according to claim 1, wherein a common element electrode wiring portion electrically conducted with the common element electrode, and a common electrode pad electrically conducted with the common element electrode wiring portion are formed at a position deviated from a region in which the pressure generating element groups and the discrete element electrode terminal are formed on the pressure generating element mounting surface, and a ground terminal of the driving IC is electrically bonded to the common electrode pad.

5. The liquid ejecting head according to claim 1, wherein the printed substrate includes a connector which is connected to an external wiring and is formed on a surface opposite to the driving IC.

6. A liquid ejecting apparatus comprising:

a liquid ejecting head, the liquid ejecting head comprising:

an actuator unit having a pressure generating element which creates pressure change in a liquid in a pressure chamber by applying a driving voltage between a discrete element electrode and a common element electrode to eject the liquid from nozzles which communicate with the pressure chamber, the actuator unit having plural pressure generating element groups in which a plurality of pressure generating elements are provided in row;

a discrete element electrode terminal which is electrically conducted with a discrete element terminal of the pressure generating element and is formed between the pressure generating element groups on a pressure generating element mounting surface of a substrate with the pressure chamber formed thereon;

a driving IC which is placed between the adjacent pressure generating element groups on the pressure generating element mounting surface;

a printed substrate which is placed at a side opposite to the substrate side of the driving IC; and an input pad which is formed at a position corresponding to an input terminal of the driving IC on the pressure generating element mounting surface;

in which an output terminal of the driving IC is electrically bonded to the discrete element electrode terminal, the input terminal of the driving IC is electrically bonded to the input pad, and the input pad is electrically bonded to a substrate terminal of the printed substrate.

7. The liquid ejecting apparatus according to claim 6, wherein the output terminal of the driving IC is bonded to the discrete element electrode terminal by using flip chip bonding.

8. The liquid ejecting apparatus according to claim 6, wherein the input pad is bonded to the substrate terminal of the printed substrate with a bonding wire.

9. The liquid ejecting apparatus according to claim 6, wherein a common element electrode wiring portion electrically conducted with the common element electrode, and a common electrode pad electrically conducted with the common element electrode wiring portion are formed at a position deviated from a region in which the pressure generating element groups and the discrete element electrode terminal are formed on the pressure generating element mounting surface, and a ground terminal of the driving IC is electrically bonded to the common electrode pad.

10. The liquid ejecting apparatus according to claim 6, wherein the printed substrate includes a connector which is connected to an external wiring and is formed on a surface opposite to the driving IC.

* * * * *